US005871363A

United States Patent [19]

Kimura

[11] Patent Number: 5,871,363

[45] Date of Patent: Feb. 16, 1999

[54] LOW INSERTION FORCE CONNECTOR

[75] Inventor: Tomohiko Kimura, Shizuoka, Japan

[73] Assignee: Yazaki Corporation, Tokyo, Japan

[21] Appl. No.: 857,825

[22] Filed: May 16, 1997

[30] Foreign Application Priority Data

May 30, 1996 [JP] Japan ..... 8-136919

[51] Int. Cl.[6] ..... H01R 13/62

[52] U.S. Cl. ..... 439/157

[58] Field of Search ..... 439/157, 310, 439/347

[56] References Cited

FOREIGN PATENT DOCUMENTS 2-123681 5/1990 Japan ..... H01R 13/639

*Primary Examiner*—Neil Abrams
*Assistant Examiner*—Javaid Nasri
*Attorney, Agent, or Firm*—Sughrue, Mion, Zinn, Macpeak & Seas, PLLC

[57] ABSTRACT

A low insertion force connector including: a male connector portion including a male housing having side walls, cam protrusions formed on the side walls, respectively, and a plurality of first contacts insertable in the male housing; a female connector portion coupled with the male connector portion, the female connector portion including a female housing, and a plurality of second contacts insertable in the female housing a slider supported to be longitudinally slidable in the female housing, the slider including cam slots engageable with the cam protrusions to draw the male connector portion to the female connector portion in a connector fitting direction as the slider slides in the female housing, and an arcuate wall formed on an end wall of the slider, the arcuate wall having a spiral groove in an inner surface thereof; and a slide mechanism provided to control the slide of the slider in the female housing, the slide mechanism including a support shaft rotatably supported on an end wall of the female housing and longitudinally extended from the end wall, and an operation lever provided on a distal end of the support shaft, the operation lever including a boss portion having a propulsion protrusion for engaging with the spiral groove.

10 Claims, 6 Drawing Sheets

LOW INSERTION FORCE CONNECTOR

BACKGROUND OF THE INVENTION

Field of the Invention

This invention generally relates to a low insertion force connector and particularly relates to a low insertion force connector having a mechanism for mutually connecting and locking plug-type and socket-type contacts in pairs.

Background

For example, a low insertion force connector can perform connector fitting with a low insertion force is disclosed in Unexamined Japanese Patent Publication No. Hei. 2-123681.

FIGS. 7 and 8 show a conventional low insertion force connector 51 including a male connector portion 53 and a female connector portion 52. The male connector portion 53 has a male housing 56 which holds either one of a set of socket-type female contacts 4 and a set of plug-type male contacts 5, for example, the set of socket-type female contacts 4. The female connector portion 52 has a female housing 61 which holds the other one of the set of socket-type female contacts 4 and the set of plug-type male contacts 5, for example, the set of plug-type male contacts 5. The set of socket-type female contacts 4 and the set of plug-type male contacts 5 make a plurality of pairs respectively. The male housing 56 has pin-shaped cam protrusions 8 formed on side walls thereof. A slider 59 is supported to slide in the female housing 61. The slider 59 has cam slots 10 respectively engaging the cam protrusions 8 so as to make the female and male contacts 4 and 5 draw each other in the connecting direction. Further, a slide mechanism 62, for sliding the slider 59 within the female housing 61, is provided in the female connector portion 52.

The low insertion force connector 51 will be described below more specifically. In the female housing 61, side walls 64 are erected vertically on the opposite sides of a bottom wall 63, and the top portions of the side walls 64 are bent inside to form longitudinal flanges 65 respectively so as to prevent the slider 59 from coming off upward. Notch portions 66 are provided in the longitudinal flanges 65 respectively so as to pass the cam protrusions 8 therethrough.

The bottom wall 63 has positioning holes 67 formed at its longitudinally opposite ends, while a large through hole 68 is formed in a central portion of the bottom wall 63. Further, center holes 69, for rotating a lever arm 73 of the slide mechanism 62, are formed in the vicinity of rear lower portions of the side walls 64, respectively.

The slider 59 has a front end wall and side walls 70 provided on both sides of the front end wall so that the slider 59 is U-shaped in plan. A suitable number of cam slots 10 are formed in each of the side walls 70. The cam slots 10 each has a protrusion receiving slot 23 for receiving one of cam protrusions 8, an inclined slot 24 for drawing the cam protrusion 8, and a lock slot 25 for locking the cam protrusion 8.

Escape slots 71 are formed in the vicinity of the rear lower portion of the side walls 70 respectively so as to avoid interference with a lever center 74 to be fitted into the center holes 69. Further, elongated holes 72 extending vertically are formed in the rear end portions of the side walls 70 respectively so that pivot protrusions 75 are fitted thereinto.

The slide mechanism 62 includes a lever arm 73 which is bent inside to form a ladder in side view and which has a channel-like cross section, a lever center 74 provided on the base portion of the lever arm 73 so as to be fitted into the center holes 69, and the pivot protrusions 75 provided to be closer to the center of the lever arm 73 than the lever center 74 so as to be fitted into the vertically elongated holes 72, respectively. A latch mechanism 76 is provided on a front end of the lever arm 73.

The latch mechanism 76 is made of a flexible material such as flexible synthetic resin or the like, and has a gate-shaped fixed leg 77, a gate-shaped free leg 78 having leg portions integrally formed with the leg portions of the fixed leg 77, and pin-shaped latch protrusions 88 provided on the opposite side surfaces of a cover member which will be described later. Further, angled arms 79, top portions 80, and catch surfaces 81 for catching and locking the latch protrusions 88 are provided on the front end surfaces of the free arm 78 in the order from the leg portion.

In the male connector portion 53, as described above, the pin-shaped cam protrusions 8 are suitably provided on the opposite side surfaces of the male housing 56 formed like a box with no ceiling and bottom plate, and a cover member 84 for covering the top opening portion of the male housing 56 is provided through a space wall 83. The cover member 84 has a bottom plate 85 and a cover body 86 which is channel-shaped in cross section, and the socket-type female contacts 4 are attached on the bottom plate 85 toward the bottom.

Further, pin-shaped latch protrusions 88 are provided on side walls 87 of the cover body 86 and wires connected to the female contacts 4 are substantially perpendicularly bent so as to be led out from a wire opening end 89.

The plug-type male contacts 5 are provided upward on an intermediate plate 41 of a male contact housing 40 and a box-shaped surrounding wall 42 having no ceiling and bottom plate is provided on the intermediate plate 41. The size of the outer width of the surrounding wall 42 is selected to be smaller than that of the inner width of the slider 59 by a clearance for fitting. Positioning holes 43 are formed in the intermediate plate 41 at its longitudinal end portions. Accordingly, if the surrounding wall 42 is inserted from the downside of the through holes 68 of the female housing 61, the intermediate plate 41 can be attached to the female housing 61 through the positioning holes 43 and 67. Thus, the female connector portion 52 is assembled. Further, since the height of the surrounding wall 42 is lower than that of the lock slot 25, the assembling operation is not interfered with the operation of the cam protrusions 8.

In the thus configured low insertion force connector 51, the male connector portion 53 is put on the female connector portion 52 in the state where the lever arm 73 is set up backward, and if the male connector portion 53 is slightly pushed down, the cam protrusions 8 are inserted into the protrusion receiving slots 23 through the notch portions 66. Then, if the front end of the lever arm 73 is pushed forward, the lever arm 73 pivots forward about the lever center 74 so that the pivot protrusions 75 move forward to thereby make the slider 59 slide forward.

Therefore, the cam protrusions 8 are strongly drown by the inclined slots 24 to the bottom side so that the female and male contacts 4 and 5 are surely connected to each other. Further, when the slider 59 slides forward, the cam protrusions 8 are guided by the lock slots 25 so that the female and male connector portions 52 and 53 are surely locked with each other. At this time, since the latch protrusions 88 abut against the angled arms 79 of the free leg 78 so that the free leg 78 is bent backward and the latch protrusions 88 get over the top portions 80 so as to be caught on the catch surfaces 81. Therefore, also the lever arm 73 is surely locked by the latch mechanism 76.

In the low insertion force connector 51, since the distance between the lever center 74 and the front end of the lever arm 73 is much longer than the distance between the lever center 74 and the pivot protrusions 75 as described above, even if the front end of the lever arm 73 is pressed with a small force, the female and male connector portions 52 and 53 can be inserted and connected to each other with a large force.

Further, in many cases, the low insertion force connector 51 is disposed in a deep place when used for a vehicle, or the like, but the connection can be performed surely and strongly only by slightly pushing the lever arm 73 down forward so that the workability is good in spite of the fact that a large number of female and male contacts 4 and 5 are connected to each other at the same time.

In the foregoing conventional low insertion force connector 51, however, the lever arm 73 is made to fall down forward when the female and male connector portions 52 and 53 are connected to each other, so that the male connector portion 53 is covered with the lever arm 73.

Accordingly, it is necessary that wires connected to the female contacts 4 attached on the male connector portion 53 must be bent and led out from the wire opening end 89. There has been therefore such a problem that the arrangement of wires is limited and the handling property is poor.

Further, although the lock slots 25 are provided in the respective cam slots 10 of the slider 59, the female and male connector portions 52 and 53 cannot be perfectly locked only by locking the cam protrusions 8 in the lock slots 25.

Further, the foregoing slide mechanism 62 and the lever arm 73 of the mechanism 62 become large in size to some degree in design so that the lever arm 73 becomes heavy in weight.

There has been therefore such a possibility that the lever arm 73 is moved by vertical vibration so that the female and male connector portions 52 and 53 are disconnected from each other so that there has been such a problem that provision of the latch mechanism 76 is required to thereby cause increase in cost.

SUMMARY OF THE INVENTION

In view of the foregoing problems, an object of the present invention is to provide a low insertion force connector which can be operated easily even in a narrow space, which is good in the handling property such as wiring or the like and which is low in cost.

In order to achieve the above object, according to the present invention, a low insertion force connector includes: a male connector portion including a male housing having side walls, cam protrusions formed on the side walls, respectively, and a plurality of first contacts insertable in the male housing; a female connector portion coupled with the male connector portion, the female connector portion including a female housing, and a plurality of second contacts insertable in the female housing a slider supported to be longitudinally slidable in the female housing, the slider including cam slots engageable with the cam protrusions to draw the male connector portion to the female connector portion in a connector fitting direction as the slider slides in the female housing, and an arcuate wall formed on an end wall of the slider, the arcuate wall having a spiral groove in an inner surface thereof; and a slide mechanism provided to control the slide of the slider in the female housing, the slide mechanism including a support shaft rotatably supported on an end wall of the female housing and longitudinally extended from the end wall, and an operation lever provided on a distal end of the support shaft, the operation lever including a boss portion having a propulsion protrusion for engaging with the spiral groove. Further, the male connector portion is releasable from the female connector portion as the cam protrusions is disengaged from the cam slots by sliding the slider in the female housing.

In the low insertion force connector having such a configuration as described above, the support shaft is longitudinally provided, so that the rotary surface of the operation lever is disposed in parallel to and outside the end wall of the female housing. Therefore, the wires connected to the female and male contacts can be arranged freely from the ceiling and bottom surfaces of the low insertion force connector to thereby improve the handling property.

In the above low insertion force connector, preferably, the cam slots each has a protrusion receiving opening for receiving one of the cam protrusions, an inclined slot for drawing the male connector portion to the female connector portion into the connector fitting direction as the slider slides in the female housing, and a lock slot for holding the male connector portion and the female connector portion in a complete fitting condition.

In the low insertion force connector having such a configuration as described above, the operation lever can be reduced in size as well as weight and it is not necessary to additionally provide the latch mechanism of the operation lever because the lock slots are provided in the ends of the cam slots. It is therefore possible to reduce the producing cost and to improve the workability in the fitting and separating operation.

DETAILED DESCRIPTION OF THE PREFERRED EMBODIMENT

Referring to FIGS. 1 through 6, an embodiment of the present invention will be described below in detail.

Figure 1:
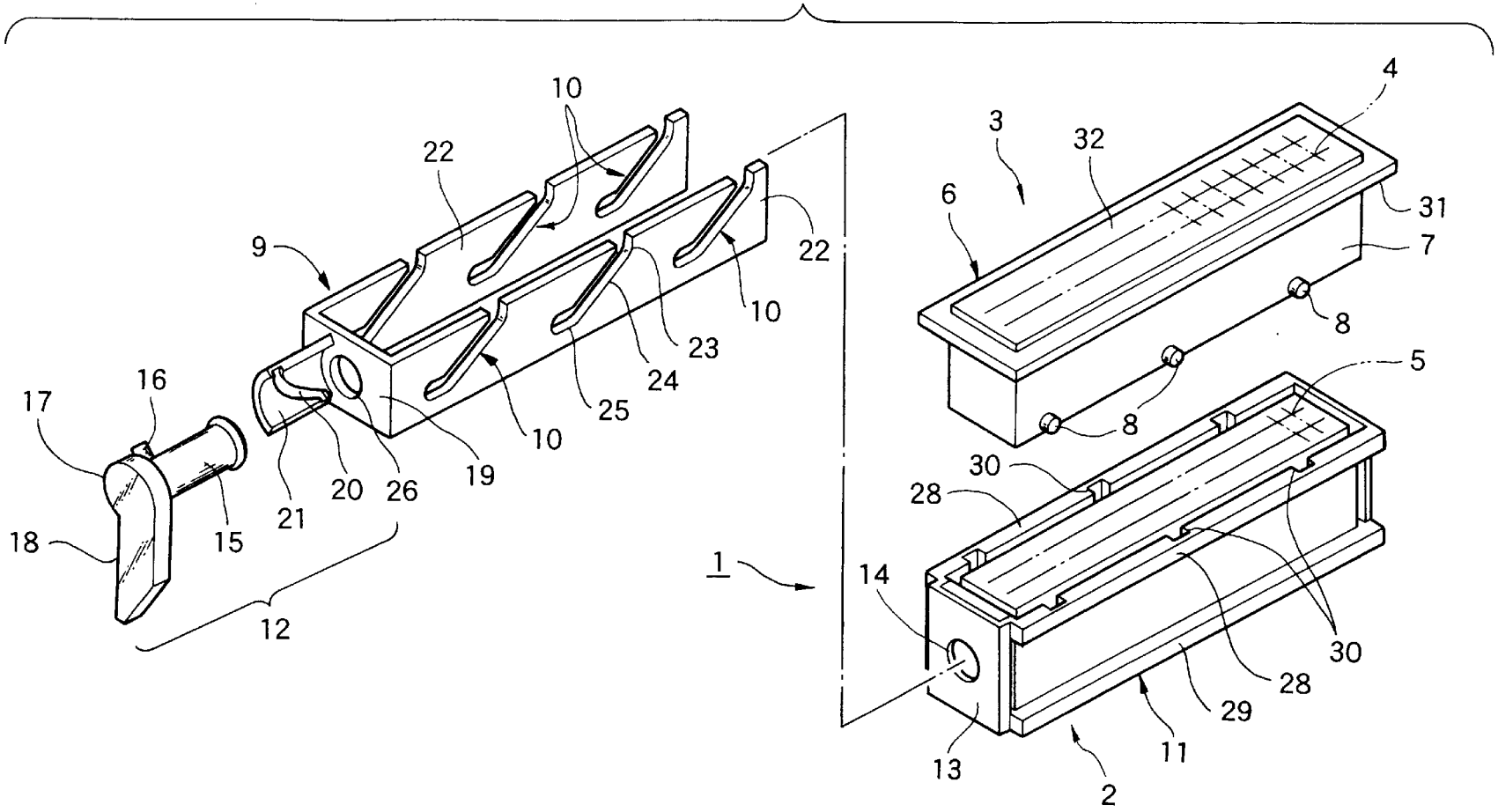
FIG. 1 is an exploded perspective view showing an embodiment of the low insertion force connector according to the present invention.
Figure 2:
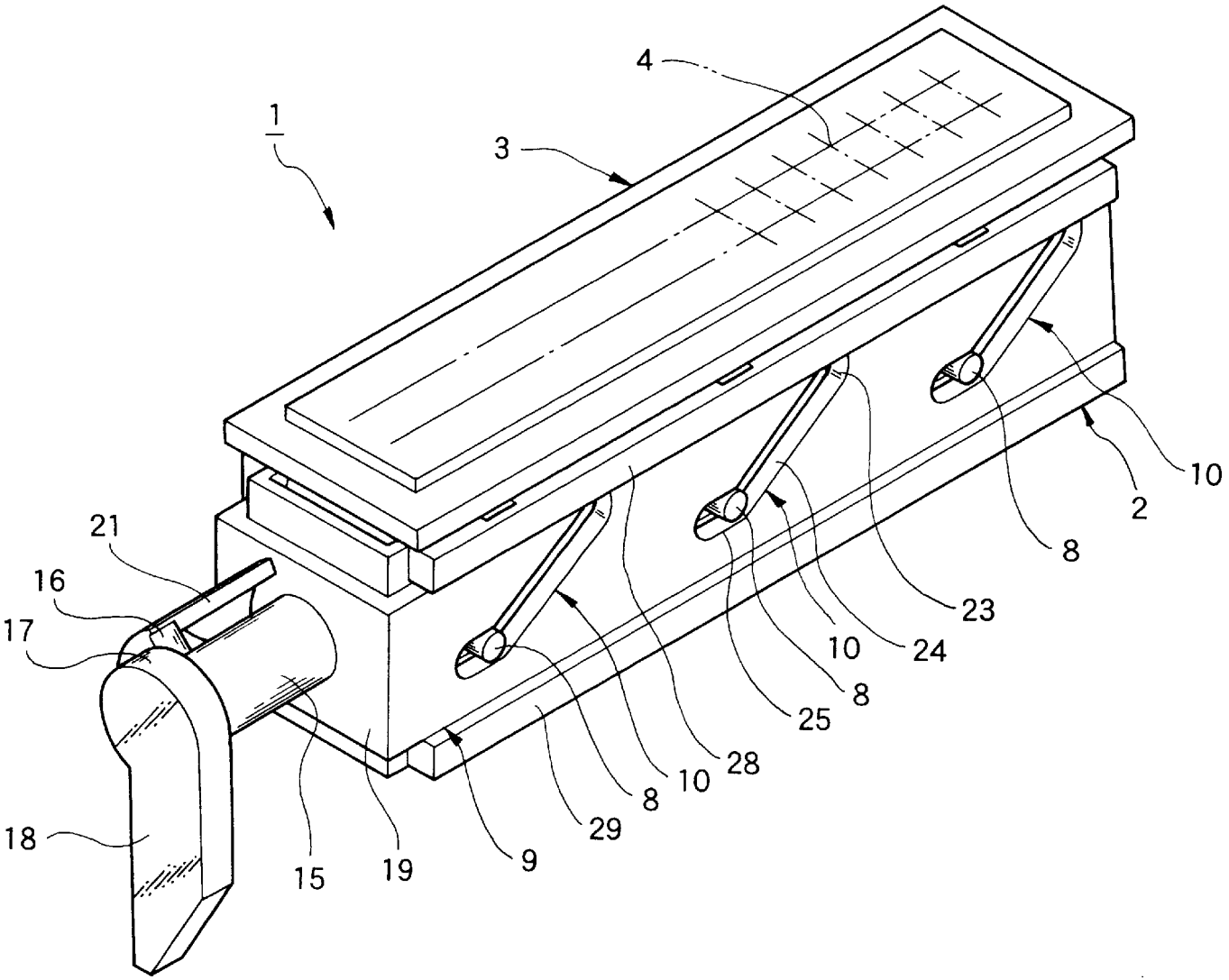
FIG. 2 is a perspective view of the assembled low insertion force connector of the embodiment showing a connection state thereof.
Figure 3:
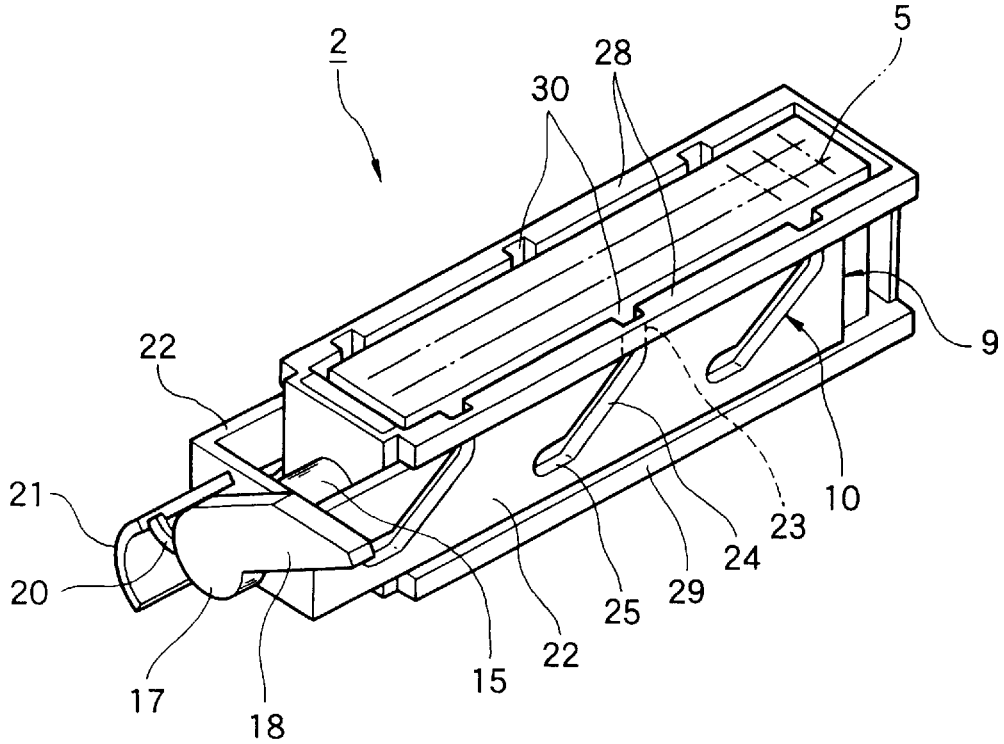
FIG. 3 is a perspective view showing the assembled female connector portion of FIG. 1.

As shown in FIGS. 1 through 3, a low insertion force connector 1 includes a pair of female and male connector portions 2 and 3. The male connector portion 3 includes a male housing 6 which holds socket-type female contacts 4.

The male housing 6 has pin-shaped cam protrusions 8 formed on side walls 7 thereof. The female connector portion 2 includes a female housing 11 which holds plug-type male contacts 5. A slider 9 which is longitudinally supported to be slidable in the female housing 11. The slider 9 has cam slots 10 for engaging the cam protrusions 8 so as to mutually draw female and male contacts 4 and 5 in the connecting direction, and a slide mechanism 12 for operating the slider 9 to slide within the female housing 11.

The slide mechanism 12 includes a support shaft 15 which is longitudinally extended and is rotatably supported in a support shaft supporting hole 14 formed in an end wall 13 of a rear portion of the female housing 11, an operation lever 18 provided on an outside end of the support shaft 15, the operation lever 18 having a propulsion protrusion 16 formed at a boss portion 17 thereof, and an arcuate wall 21 formed on an end wall 19 of a rear portion of the slider 9 so as to extend horizontally therefrom, the arcuate wall 21 having a spiral groove 20 for engaging with the propulsion protrusion 16 at an inner surface thereof.

The slider 9 has side walls 22 formed on both sides thereof, the above-mentioned end wall 19 formed at rear end thereof, and a suitable number of cam slots 10 formed in each of the side walls 22. The cam slots 10 each has a protrusion receiving slot 23 for receiving the cam protrusion 8, an inclined slot 24 for drawing the cam protrusion 8, and a lock slot 25 for locking the cam protrusion 8. Further, a through hole 26 is formed in the end wall 10 so that the support shaft 15 is passed through the through hole 26 and supported rotatably and longitudinally slidable.

The female housing 11 is formed into an elongated box-like shape having no ceiling plate, and the male contacts 5 are attached in the inside of the female housing 11 such that connection wires are led out from a bottom wall thereof. Further, flanges 28 and 29 longitudinally extends and are formed so as to project outwardly from upper and lower outer edge portions of both sides of the female housing 11 respectively so that the flanges 28 and 29 guide and support the side walls 22 of the slider 9 so as to make the side walls 27 be slidable longitudinally. Notch portions 30 are formed in the upper edge portions of the flanges 28 and 29 respectively so that the cam protrusions 8 pass therethrough. Moreover, the plug-type male contacts 5 are attached in advance on the bottom wall of the female connector portion 2 toward the fitting direction of the male connector portion 3 and a plurality of connection wires (not shown) are distributed in desired directions from the bottom wall.

The male housing 6 is formed into an elongated box-like shape having no ceiling plate and no bottom plate, and the suitable number of cam protrusions 8 are formed on the side walls 7 at positions near the bottom of the male housing 6. Further, a flange 31 including end wall portions is formed circumferentially on an upper portion of the male housing 6. A mount plate 32 has a function as a ceiling plate and is provided on the top portion of the male housing 6 for mounting and holding the female contacts 4. The socket-type female contacts 4 are mounted on the mounted plate 32 of the male connector portion 3 in the fitting direction of the female connector portion 2, and a plurality of connection wires (not shown) are distributed from the ceiling portion of the male housing 6 in the desired directions.

The support shaft 15 is held by the flange 31 and, for example, a snap ring (not shown) or the like so that the support shaft 15 is not longitudinally slid although the support shaft 15 is rotatably supported while being in contact with an inner wall of the support shaft supporting hole 14 of the female housing 11.

In the foregoing low insertion force connector 1 according to this embodiment, first, the support shaft 15 is inserted through the through hole 26 of the slider 9. At this time, the support shaft 15 is inserted while the operation lever 18 is being rotated in the state where the propulsion protrusion 16 is engaged with the spiral groove 20 provided in the inner surface of the arcuate wall 21.

Next, the slider 9 is assembled into the female connector portion 2 as shown in FIG. 3. More specifically, the opposite side walls 22 and 22 of the slider 9 are inserted between the flanges 28 and 29 of the female connector portion 2 and at the same time the support shaft 15 is supported in the support shaft supporting hole 14 so as to be positioned by the snap ring or the like.

Figure 4:
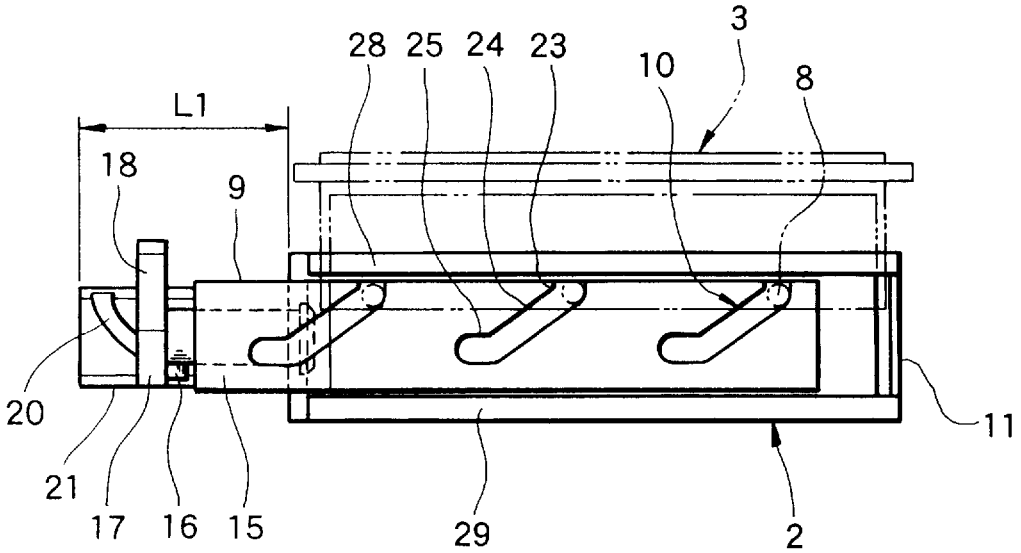
FIG. 4 is a side view for explaining the operation of the connector of FIG. 2.

Next, as shown in FIG. 4, when the male connector portion 3 is slightly pushed into the female connector portion 2 from above in the drawing, the cam protrusions 8 pass through the notch portions 30 so as to be accommodated in the protrusion receiving slots 23 of the cam slots 10. At the same time, front ends (not shown) of the female and male contacts 4 and 5 corresponding to each other are made into contact to start the connecting operation.

Figure 6:
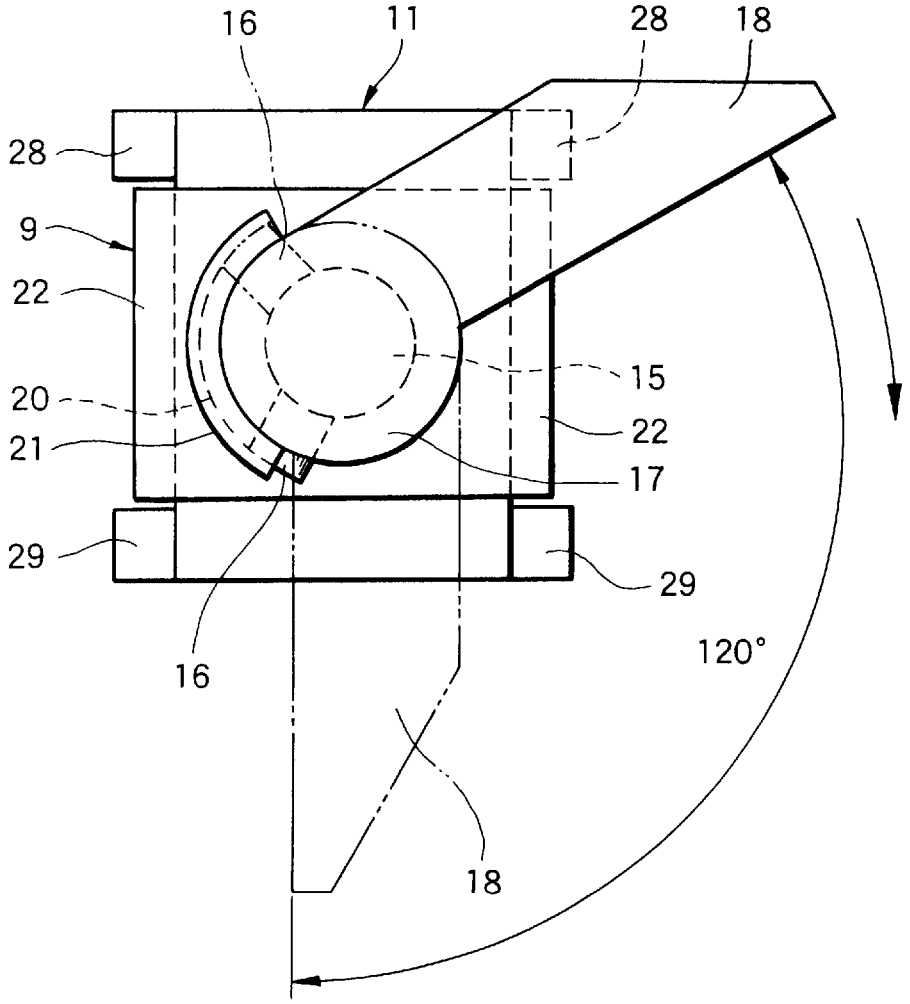
FIG. 6 is a back view showing the rear side of the connector of FIG. 2 for explaining the operation thereof.
Figure 7:
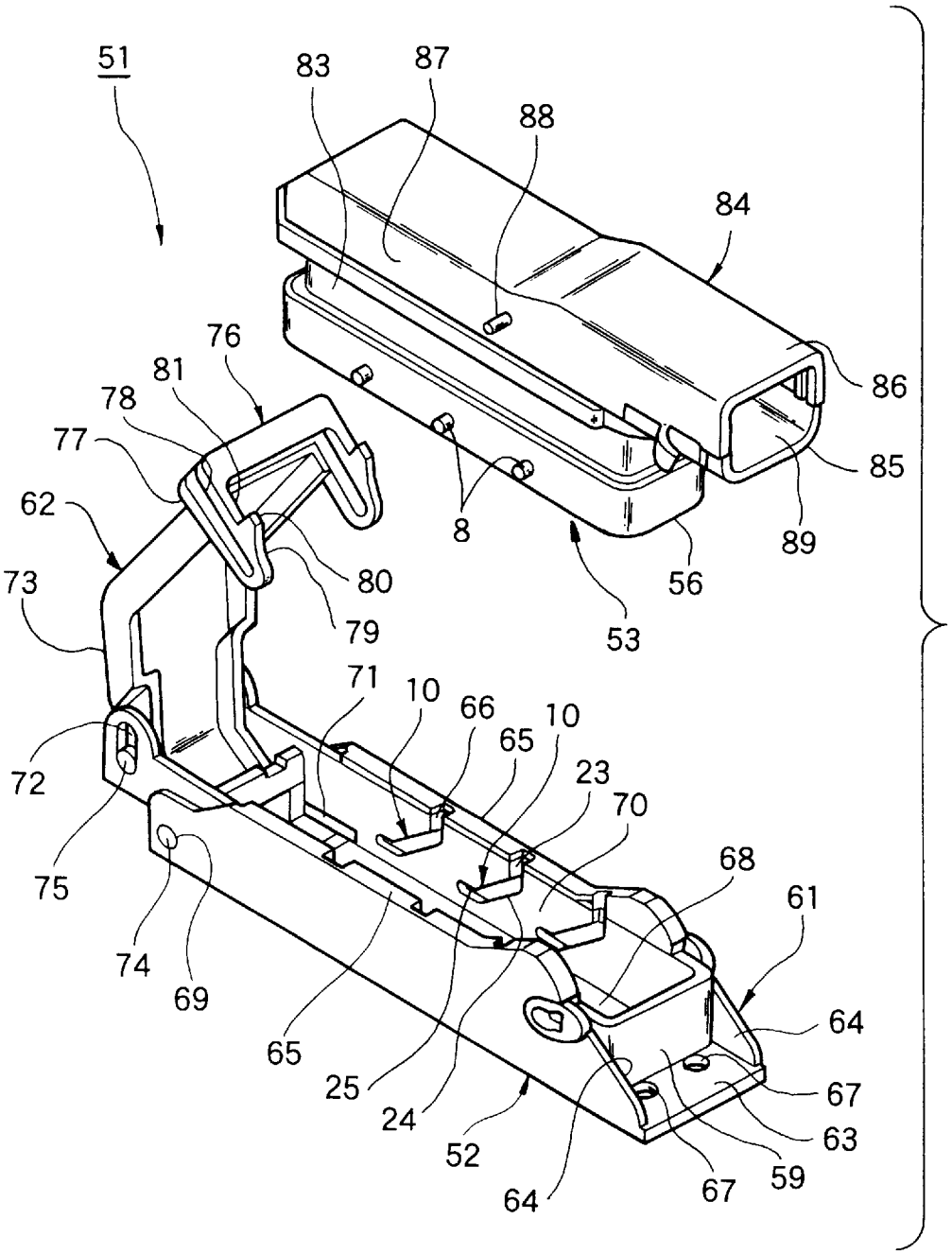
FIG. 7 PRIOR ART
FIG. 7 is an exploded perspective view showing an example of a conventional low insertion force connector.
Figure 8:
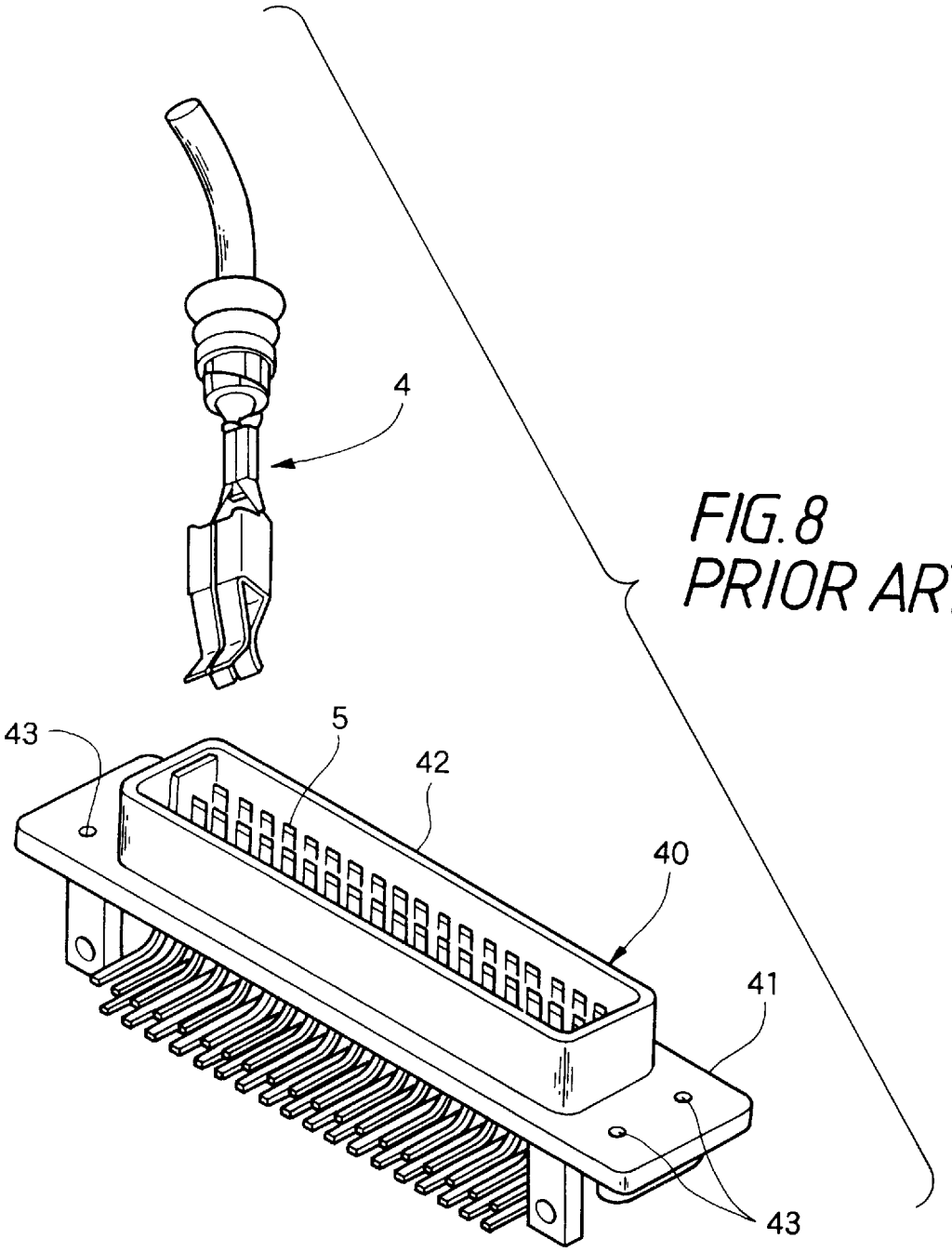
FIG. 8 PRIOR ART
FIG. 8 is an exploded perspective view showing the shape and arrangement of the female and male contacts in FIG. 7.

Then, in this embodiment, when the operation lever 18 is rotated clockwise as shown in FIG. 6, the support shaft 15 and the propulsion protrusion 16 cannot move longitudinally by the end wall 13 of the female housing 11 while they can rotate relative to the female housing 11.

Therefore, when the propulsion protrusion 16 rotates in the spiral groove 20 of the arcuate wall 21, the slider 9 is guided between the flanges 28 and 29 of the female housing 11 and moved toward the female housing 11.

Figure 5:
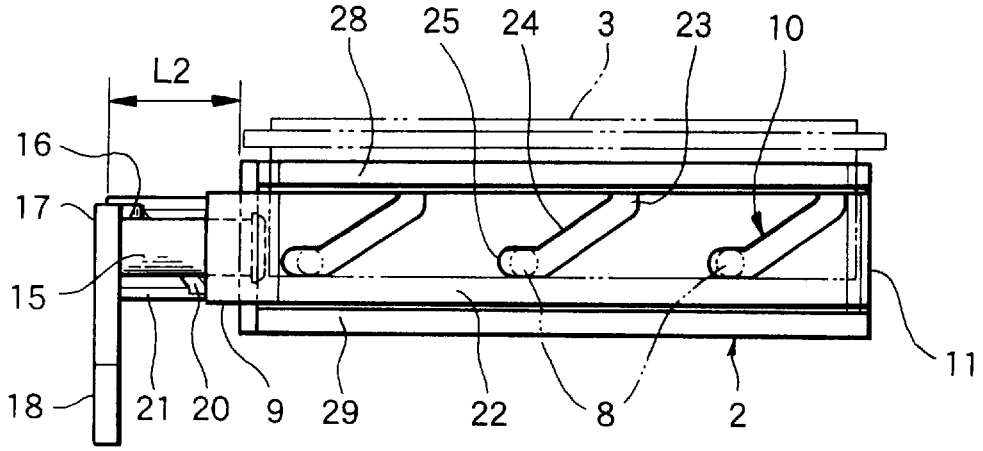
FIG. 5 is a side view for explaining the operation of the connector of FIG. 4 in the connection completion state.

Then, since the cam protrusions 8 are guided by the inclined slots 24 so as to be pushed downwardly as shown in FIG. 5, the male connector portion 3 is drown, in the fitting direction, into the female connector portion 2. At this time, a large insertion force can be obtained by a small rotary force, because the propulsion protrusion 16 is provided on the boss portion 17 so that the ratio of rotating radius of the operation lever 18 to the propulsion protrusion 18 is large.

Therefore, the female and male connector portions 2 and 3 as well as the female and male contacts 4 and 5 are surely fitted and connected to each other, respectively.

When the operation lever 18 is rotated in the direction of an arrow in FIG. 6, for example, by 120°, in this embodiment, the distance between the rear end surface of the female housing 11 and the rear end surface of the arcuate wall 21 is reduced from the length L1 to the length L2 as shown in FIGS. 4 and 5 so that the cam protrusions 8 are guided into the lock slots 25 of the cam slots 10 respectively. Accordingly, the female and male connector portions 2 and 3 are perfectly fitted, connected and locked to each other. Therefore, the fitted state is hardly loosened by vibration or the like even in the case of providing no special latch mechanism. When the connection of the female and male connector portions 2 and 3 is to be released, it will do to merely rotate the operation lever 18 in the direction reverse to that in the connecting operation. Accordingly, the fitting and separating work can be carried out easily.

In the foregoing low insertion force connector 1 according to this embodiment, the slider 9 having the cam slots 10 through which the female and male connector portions 2 and 3 are inserted and connected to each other is operated so as to be moved by using: the operation lever 18 provided on the outside end of the longitudinally extending support shaft 15 and having the propulsion protrusion 16 provided at the boss portion 17 of the operation lever 18; and the arcuate wall 21 horizontally provided on the end wall of the slider 9 and having, at its inner surface, the spiral groove 20 which engages with the propulsion protrusion 16.

Therefore, since the support shaft 15 is formed longitudinally and since the rotary surface of the operation lever 18 is disposed in parallel to the wall surface of the end wall 13 of the female housing 11 and supported in the support shaft supporting hole 14 of the end wall 13, the arrangement of the wires to be connected to the female and male connector portions 2 and 3 is free and the handling property can be improved.

Moreover, the operation lever 18 is reduced in size and weight, and when the lock slots 25 are provided in the end portions of the cam slots 10, it is not necessary to additionally provide the latch mechanism for locking the operation lever 18 so that the producing cost is reduced and the workability in the fitting and separating operation can be improved.

As described above, in the low insertion force connector according to the present invention, the slide mechanism includes the support shaft longitudinally extended and rotatably supported on the end wall of the female housing, the operation lever provided on the outside end of the support shaft and having the propulsion protrusion provided at its boss portion, and the arcuate wall horizontally provided on the end wall of the slider and having, at its inner surface, the spiral groove which engages with the propulsion protrusion.

Further, the cam slots are provided in the side walls of the slider, respectively. The cam slots each has the protrusion receiving slot for receiving the cam protrusion, the inclined slot for drawing the female and male contacts in the direction of mutual connection, and the lock slot for holding the female and male contacts in the position of mutual connection.

Thus, since the support shaft is formed longitudinally so that the rotary surface of the operation lever is disposed in parallel to and outside the end wall of the female housing, the freedom of arrangement of wires to be connected from the ceiling and bottom surfaces of the connector portions is increased to thereby improve the handling property.

Further, since the operation lever can be reduced in size and weight and since it is not necessary to additionally provide the latch mechanism for locking the operation lever because the lock slots are provided in the end portions of the cam slots, the producing cost can be reduced and the workability in the fitting and separating operation work can be improved.

What is claimed is:

1. A connector, comprising:

a male connector portion including:

a male housing having side walls, cam protrusions formed on the side walls, respectively, and a plurality of first contacts insertable in the male housing;

a female connector portion for coupling with the male connector portion, the female connector portion including:

a female housing, and a plurality of second contacts insertable in the female housing;

a slider supported to be longitudinally slidable in the female housing, the slider including:

cam slots engageable with the cam protrusions to draw the male connector portion to the female connector portion in a connector fitting direction as the slider slides in the female housing, and an arcuate wall formed on an end wall of the slider, the arcuate wall having a spiral groove in an inner surface thereof; and a slide mechanism provided to control the slide of the slider in the female housing, the slide mechanism including:

a support shaft rotatably supported on an end wall of the female housing and longitudinally extended from the end wall, and an operation lever provided on a distal end of the support shaft, the operation lever including a boss portion having a propulsion protrusion for engaging with the spiral groove.

2. The connector of claim 1, wherein the cam slots each has:

a protrusion receiving opening for receiving one of the cam protrusions, an inclined slot for drawing the male connector portion to the female connector portion into the connector fitting direction as the slider slides in the female housing, and a lock slot for holding the male connector portion and the female connector portion in a complete fitting condition.

3. The connector of claim 1, wherein the slider is slidable in the female housing as the support shaft is rotated.

4. The connector of claim 1, wherein the male connector portion is releasable from the female connector portion as the cam protrusions is disengaged from the cam slots by sliding the slider in the female housing.

5. The connector of claim 1, wherein the first contacts and the second contacts are connected to each other as the male connector portion and the female connector portion are fitted to each other.

6. The connector of claim 1, wherein the slider further includes through hole formed in the end wall thereof, and wherein the support shaft rotatably supported on an end surface the female housing through the through hole.

7. The connector of claim 1, wherein the slider further includes side walls extended from both sides of the end wall, the cam slots are formed in the side walls, respectively.

8. The connector of claim 1, wherein the female housing has recessed portions for receiving the slider.

9. The connector of claim 1, wherein the slider is slidable in the female housing as the support shaft is rotated while the propulsion protrusion engages with the spiral groove.

10. The connector of claim 7, wherein the female housing has recessed portions for receiving the side walls of the slider respectively.

* * * * *